United States Patent [19]

Grundman

[11] 4,022,233

[45] May 10, 1977

[54] VENETIAN UMBRELLA

[76] Inventor: Erwin W. Grundman, 15120 Woodruff Ave. Apt. No. 7, Bellflower, Calif. 90706

[22] Filed: Aug. 25, 1975

[21] Appl. No.: 607,428

[52] U.S. Cl. ..... 135/20 M; 135/5 C; 135/8; 135/34; 224/5.1

[51] Int. Cl.[2] ..... A45B 11/02; A45B 15/00

[58] Field of Search ..... 135/8, 16, 20 R, 34, 135/47, 20 M; 47/20, 21, 26, 28, 28.1; 224/5.1

[56] References Cited

UNITED STATES PATENTS

| | | | |
|---|---|---|---|
| 321,722 | 7/1885 | Herron | 135/5 X |
| 753,877 | 3/1904 | Gra | 224/5.1 |
| 1,072,339 | 9/1913 | Liljegran | 47/21 |
| 1,072,340 | 9/1913 | Liljegran | 47/21 |
| 2,223,253 | 11/1940 | Hamilton | 224/5.1 |
| 2,502,984 | 4/1950 | Parmenter | 135/20 R |
| 2,546,228 | 3/1951 | Martini | 135/20 R |
| 2,628,797 | 2/1953 | Campomar | 135/20 R |
| 3,021,985 | 2/1962 | Sarrer | 224/5.1 |
| 3,875,952 | 4/1975 | Black | 135/8 |

*Primary Examiner*—Werner H. Schroeder
*Assistant Examiner*—Conrad L. Berman
*Attorney, Agent, or Firm*—Ronald L. Juniper

[57] ABSTRACT

An umbrella structured device which retracts to a compact size including an encircling, retractable and extendable outer drape which can substantially completely protect the umbrella user from rain or other inclement weather. A collapsible attachment provides a means for carrying the umbrella while freeing the user's hands.

10 Claims, 9 Drawing Figures

VENETIAN UMBRELLA

BACKGROUND OF THE INVENTION

Prior to this invention the user of a conventional umbrella, when caught in a rainstorm, was often not adequately protected. Because of windswept rain or splashing causing somewhat horizontal movement of the rainwater a person could become quite wet even when using an umbrella in such situations. This was due to the fact that an ordinary umbrella was designed to protect from rain falling primarily straight down and the umbrella could be pointed in just one direction for only limited protection.

Thus, people often were soaking wet in windy rainstorms even if they had a conventional umbrella in use. Moreover, though the rainstorm was without substantial wind, as a person moved, he would step out of the limited protection of an ordinary umbrella and tend to get his knees and legs wet.

In essence, an ordinary umbrella provides very limited protection in windstorms and mainly is useful only while standing still in rain falling nearly straight down. Thus, a need developed for a rain protection structure which was as compact and easily carried as an ordinary umbrella, but which afforded more complete protection from getting wet. Accordingly, it is a primary purpose of this invention to provide a structure which nearly completely protects a person from a wide variety of inclement weather conditions, including windblown rain. At the same time this device is as compact and easy to carry as a ordinary umbrella.

SUMMARY

A structure in accordance with this invention includes a basic umbrella formed with a central supporting shaft, upper outwardly extending collapsible ribs carrying protective fabric thereon and a compacting mechanism. Adjustably extendable down as far as desired from the outer ends of the umbrella ribs is an encircling drape which sealingly abuts the outer edge portion of the top protective fabric. Means are provided for lowering or raising the drape and for holding it in the desired position.

A shoulder carrying means is attachable and collapsible with the umbrella so as to provide a structure which will release the user's hands when desired. Also, an attachment can be used for securing this umbrella device in the ground. Further, by enlarging the basic structure and changing the type of encircling panel the device can be used as a small tent for the beach or camping.

DETAILED DESCRIPTION OF A PREFERRED FORM OF THE INVENTION

Figures 1, 2, 3, 4, 5, 6, 7, 8, 9:
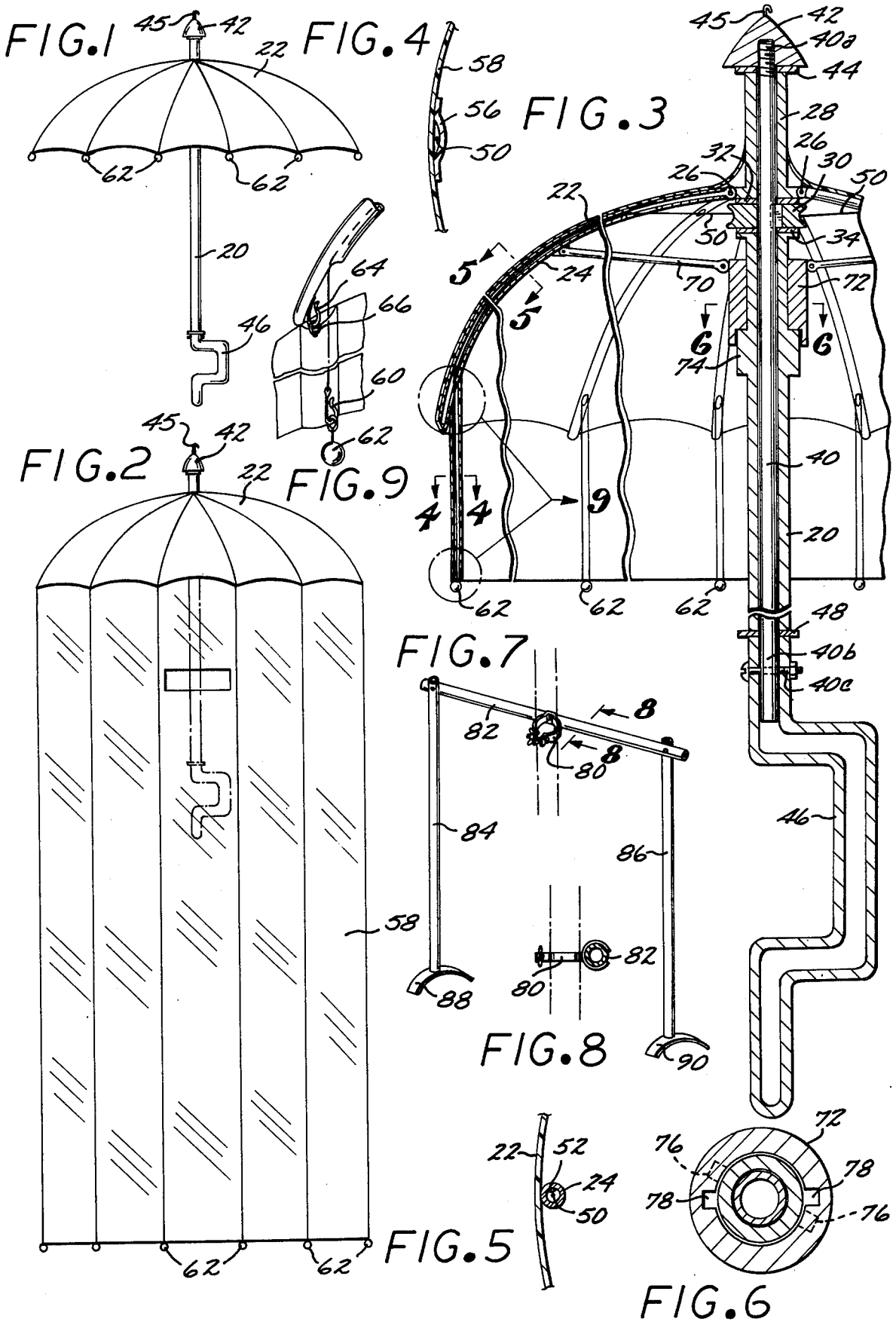
FIG. 1 is a side diagramatic view of an open umbrella in accordance with this invention with drape material foldably retracted.
FIG. 2 is a side diagramatic view of an umbrella in accordance with this invention with circumferential long drape panels extending down in use.
FIG. 3 is a vertically sectioned, fragmented view of the operative mechanism of the subject umbrella.
FIG. 4 is a cross sectional view taken through 4—4 in FIG. 3.
FIG. 5 is a cross-sectional view taken through 5—5 in FIG. 3.
FIG. 6 is a cross-sectional view taken through 6—6 in FIG. 3.
FIG. 7 is an isometric view of a folding attachable shoulder support bracket.
FIG. 8 is a cross-sectional view taken through 8—8 in FIG. 7.
FIG. 9 is an enlarged fragmented view of 9—9 in FIG. 3.

As shown in the drawings, the umbrella includes a tubular center pole 20 from which, near the top end, a collapsibly supported top cover 22 circumferentially extends outwardly. The top cover 22 is normally made of water repellant flexible fabric material and is supported when opened to stretch the fabric tight by a plurality of spaced ribs 24 which extend radially outward from their hinged connections 26 with the bottom of a tubular ribtop 28 which serves as an axially aligned spaced top extension of the center pole 20.

A rotatable hollow spool 30 is positioned so as to be axially aligned in the space underneath the rib connections 26 between the bottom of ribtop 28 and top of pole 20. A top spool ring bearing 32 and a bottom spool ring bearing 34 on the respective ends of spool 30 facilitate its rotation.

An inner elongated shaft 40, adapted to be fitted for rotation therein, extends down out the bottom of center pole 20 and up out the top of ribtop 28. The top and 40 A of shaft 40 is secured in a top cap 42 mounted for rotation on cap ring 44. A small hook 45 on cap 42 facilitates hanging when not in use. The bottom end 40B is secured by bolt 40C in a U-shaped crank handle 46 mounted for rotation relative to the bottom of center pole 20. A crank ring 48 between handle 46 and pole 20 acts as a bearing during rotation between their elements.

The spool 30 is secured to shaft 40 so that it rotates therewith as crank handle 46 is turned. A plurality of nylon threads 50 are secured to spool 30 so that they are wound up around spool 30 as it is rotated in one direction and unwound when rotated in the opposite direction. Each of these threads 50 extends out from the spool 30 to enter into a rib 24 within which it slides in a hollow center portion therein 52.

The threads 50 extend out of the ribs 24 near their outerends into and through inlaid recesses of elongated fitted thread casings 56 which extend down from each rib 24 within an encircling outer drape 58, comprised of long circumferential panels of sheer water repellant transparent plastic material. The ends of the threads 50 are secured to weight hooks 60 at the bottom of the panel 58. The weights shown take the form of balls 62 attached to hooks 60 so as to hold down the bottom of drape 58. Preferably the balls 62 are covered with a soft material to prevent hurting a user's legs.

The top of the drape 58 is attached adjacent to the top cover 22 by means of pin hooks 64 secured near the outer ends of each of the ribs 24 just below the outlets for threads 50. These pin hooks 64, in turn, are fitted in reinforced eye holes 66 in the top of the drape 58 so as to hold it up against the cover 22. The drape 58 is long enough when extended that it will encircle a user's body nearly to the ground. The drape 58 is extended to the desired length or foldably retracted by a user turning crank handle 46 which rotates spool 30 thereby pulling or releasing threads 50 so as to raise or lower panel 58 as the bottom secured weighted balls 62 are moved. In order to detach the drape 58, it is pulled all the way up, the balls 62 removed from their hooks 60, the threads 50 slid out of their casings 56 and the pin hooks 64 released from the top of drape 58. A replacement panel 58 is attached by reversing this procedure.

The umbrella cover 22 is held in its open position, when the ribs 24 are extended tight and securely supported by rib spreaders 70. These spreaders 70 are each hingedly connected at their opposite respective ends to a rib 24 and a rib support spool 72 which is mounted on pole 20 below spool 30. When held in open position, as shown in FIG. 3, clips 74 extending out form pole 20 are lodged securely in shallow mating clip slots 76, formed in the bottom abutting portion of rib extender spool 72. In collapsing the umbrella, the rib extender spool 72 is dislodged from clips 74 and turned slightly until they are aligned with mating clip slots 78 extending longitudinally therein. This allows spool 72 to slide down pole 20 over clips 74 to release the tension on hinged rib extenders 70, thereby, causing the supported ribs 24 to fold against pole 20.

Should carrying the umbrella in one hand become a problem, a shoulder support bracket as shown in FIG. 8 can be provided. This bracket consists of a rounded spring clamp 80 adapted to tension fit on pole 20 and to slide up and down thereon. Pivotally attached to clamp 80 is a cross piece 82 which is preferably slotted for side to side movement. Pivotally attached at each opposite end of cross piece 82 are support members 84 and 86 which terminate respectively with bottom pivotal or stationary rounded shoulder rests 88 and 90.

The shoulder bracket is adapted to fold flat against the umbrella center pole 20 when not in use, and is pivotal to coordinate when shoulder movements are used. It is light in weight, and compact, in that it is normally made of light tubular material.

The basic structure hereinbefore described can be modified for a multitude of uses. For instance, it may be desirable to add a small window in the panelling at eye level to facilitate vision. If the umbrella structure is enlarged from the conventional size, it can be used as a small tent for the beach, or camping. Here, it may be desirable to provide for telescopic extension of pole 20 or add an elongated pointed pole extension, so that the device can be lodged in the ground. Accordingly, it may be necessary to change the drape 58 from a transparent water-repellent material to an opaque or screening material. The weights in the form of balls 62 can be decorative and may be adjusted for different panels, though they should provide sufficient balanced weight to hold the drape 58 down, but not so much that they will pull the drape 58 below predetermined positions.

Other variations and modifications becoming apparent from this disclosure are intended to be covered by my invention, as defined by the spirit of the following appended claims and amplifications thereof.

I claim:

1. An umbrella of the type which includes a center pole comprising a first outer tube and a second inner tube adapted to rotate within said first tube, from which radiate a plurality of collapsible ribs supporting a top cover material and radiating from said first outer tube including an encircling drape of material attached near the outer circumferential edges of said cover material; said drape being extendible down to a predetermined length; and control means connected through each rib provided to foldably raise and lower said drape.

2. An umbrella as defined in claim 1 wherein the means to raise and lower said drape includes pulling elements attached to slide within said drape and be movably responsive to the same control means associated with said center pole.

3. An umbrella as defined in claim 2 wherein said pulling elements are threads attached to the bottom of said drape extending up within the drape to said umbrella ribs.

4. An umbrella as defined in claim 3 wherein said control means is without spring tension and includes a crank attached to said center pole.

5. An umbrella as defined in claim 4 wherein the threads attached to said drape extend to the center pole and are all simultaneously responsive solely to rotation of the crank to raise and lower the drape.

6. An umbrella as defined in claim 5 wherein a thread spool is mounted for rotation on said center pole, said threads are attached to said spool and said thread spool is rotated by turning said crank to simultaneously wind and unwind said threads thereby evenly raising and lowering the attached drape.

7. An umbrella as defined in claim 6 wherein said center pole is hollow and said crank is rotatably connected with said spooly by a shaft extending axially for rotation within said center pole.

8. An umbrella as defined in claim 7 wherein said umbrella ribs are hollow with openings near opposite ends and said threads are guided between said spool and said drape continuously within said hollow ribs.

9. An umbrella as defined in claim 8 wherein weights are attached to the bottom of said drape sufficient to hold said drape in unlimited selected positions without interfering with the raising and lowering of said drape.

10. An umbrella as defined in claim 9 which includes a shoulder support bracket having a cross piece, a pair of support members pivotally connected to each ends of said cross piece, and shoulder rests on the ends of each of said support members adapted to rest on an umbrella's user's shoulders wherein said cross piece is pivotally connected to said center pole so that it, said shoulder supports and said connected shoulder rests can be folded compactly substantially flush against said center pole.

* * * * *